US006129213A

United States Patent [19]

Edwards

[11] Patent Number: 6,129,213

[45] Date of Patent: Oct. 10, 2000

[54] MAGNETIC TRASH CONTAINER LID WITH PLATE SCRAPER

[76] Inventor: Richard E. Edwards, 7039 Island Village Dr., Long Beach, Calif. 90803

[21] Appl. No.: 09/120,909

[22] Filed: Jul. 22, 1998

[51] Int. Cl.[7] ..... B03C 1/00

[52] U.S. Cl. ..... 209/214; 209/223.1; 209/636; 209/926; 220/254

[58] Field of Search ..... 209/213, 223.1, 209/636, 926, 214; 220/254

[56] References Cited

U.S. PATENT DOCUMENTS

| | | | |
|---|---|---|---|
| D. 331,133 | 11/1992 | Edwards | D34/11 |
| 1,138,889 | 5/1915 | Rand . | |
| 1,930,108 | 10/1933 | Reeder | 209/228 |
| 2,587,158 | 2/1952 | Hofberg | 209/81 |
| 2,698,450 | 1/1955 | Mack | 15/121.1 |
| 2,869,795 | 1/1959 | Higer | 241/301 |
| 3,157,904 | 11/1964 | Flodell | 15/511 |
| 3,283,899 | 11/1966 | Vedvik et al. | 209/111.8 |
| 3,301,397 | 1/1967 | Stutz | 209/73 |
| 3,394,806 | 7/1968 | Vaillette | 209/111.9 |
| 3,599,788 | 8/1971 | Fyje et al. | 209/46 X |
| 3,877,577 | 4/1975 | Richard | 209/73 |
| 3,938,533 | 2/1976 | Richard | 134/63 |
| 4,049,544 | 9/1977 | Turner | 209/45 |
| 4,171,262 | 10/1979 | Lattmann et al. | 209/555 |
| 4,203,537 | 5/1980 | McAllister | 222/570 |
| 4,279,744 | 7/1981 | Antonwitsch | 209/214 |
| 4,367,138 | 1/1983 | Kustas | 209/224 |
| 4,480,753 | 11/1984 | Thomas et al. | 209/546 |
| 4,494,657 | 1/1985 | Oldenkamp | 209/636 |
| 4,632,253 | 12/1986 | Stromgren et al. | 209/570 |
| 4,706,818 | 11/1987 | Zutell et al. | 209/636 |
| 4,782,970 | 11/1988 | Edwards | 220/1 R |
| 5,538,143 | 7/1996 | Pettersson | 209/698 |
| 5,797,497 | 8/1998 | Edwards | 209/570 |

FOREIGN PATENT DOCUMENTS

| | | | |
|---|---|---|---|
| 2385451 | 12/1978 | France | 209/926 |
| 2547474 | 5/1977 | Germany . | |
| 2610272 | 9/1977 | Germany . | |
| 2944192 | 5/1981 | Germany . | |
| 3208533 | 11/1982 | Germany . | |

OTHER PUBLICATIONS

KatchAll Industries Midwest, Inc.; "KatchAll Products Reduce Foodservice Overhead, Repairs"; 2 pages.

Dripcut Corporation; "Magnetic Products"; 1 page.

*Primary Examiner*—Tuan N. Nguyen

*Attorney, Agent, or Firm*—Stetina Brunda Garred & Brucker

[57] ABSTRACT

A trash container lid facilitates easy disposal of food scraps while inhibiting inadvertent disposal of tableware. The trash container lid includes a cover configured to cover at least a portion of an opening in a trash container. A chute is formed in the cover and is configured to receive food scraps and to direct the food scraps into the trash container. At least one magnet is disposed proximate the chute to catch tableware inadvertently introduced thereinto. A scraper blade is formed to the cover proximate the chute such that food scraps scraped from plates and the like with the scraper fall through the chute and into the trash container.

18 Claims, 2 Drawing Sheets

MAGNETIC TRASH CONTAINER LID WITH PLATE SCRAPER

FIELD OF THE INVENTION

The present invention relates generally to trash disposal containers and more particularly to a trash container lid for facilitating easy disposal of food scraps while inhibiting inadvertent disposal of tableware and the like.

BACKGROUND OF THE INVENTION

Trash containers for disposing of food scraps and the like are well known. Frequently, such trash containers comprise a generally cylindrical trash can having an open top. A cover may be disposed atop the trash container. The cover either has an opening formed therein or a door attached thereto.

Such trash containers are commonly used in restaurants, fast food establishments, cafeterias, and the like. Sometimes, the customers themselves clean food scraps off of their plates. More often, kitchen personnel are responsible for scraping food scraps from the plates prior to the plates being placed into an automatic dishwasher.

As used herein, the word plate is defined to include plates, dishes, bowls, trays and the like, upon or within which food is disposed.

One of the problems commonly associated with the cleaning of plates is the inadvertent disposal of tableware, e.g., knives, forks, and spoons. As those skilled in the art will appreciate, it is not uncommon for pieces of tableware to be obscured beneath food scraps, or for kitchen personnel, in their haste to clean the plate, to miss even clearly visible tableware.

Metal tableware, typically formed from stainless steel, is very durable and is intended for long-term use. Such stainless steel tableware is also comparatively expensive. Therefore, it is highly undesirable to inadvertently dispose of such tableware. Indeed, the cost of replacing such stainless steel tableware can be substantial, particularly if it is routinely being lost.

Food scraps are typically scraped from plates, trays, and the like. Kitchen personnel commonly utilize tableware, rubber spatulas, or the like to scrape food scraps from plates prior to placing the plates in an automatic dishwasher.

As those skilled in the art will appreciate, the use of such rubber spatulas and the like to scrape food scraps from plates is comparatively time consuming and inefficient. Further it requires that a spatula be readily available. Such spatulas must also periodically be replaced at some cost to the purchaser.

When such a spatula or other implement is used to scrape food from plates, then one hand is used to hold the spatula, while the other hand holds the plate. Such manual operation is comparatively slow. It is substantially limited to the scraping of one plate at a time.

In view of the foregoing, it is desirable to provide a device for preventing the inadvertent disposal of tableware. It is also desirable to provide a device for scraping food scraps from plates which is easy to use, time efficient, and cost-effective. More particularly, it is desirable to provide a device which allows a user to hold a plate in each hand while effecting scraping thereof, thereby effectively doubling the number of plates which may be scraped in any given time period.

SUMMARY OF THE INVENTION

The present invention specifically addresses and alleviates the above-mentioned deficiencies associated with the prior art. More particularly, the present invention comprises a trash container lid for facilitating easy disposal of food scraps while inhibiting inadvertent disposal of tableware. The present invention also comprises a method for using the same.

The trash container lid comprises a cover configured to cover at least a portion of an open trash container. A chute is formed in the cover and is configured to receive food scraps and to direct the food scraps into the trash container. At least one, preferably two, magnets are disposed proximate the chute, e.g., attached thereto, so as to catch magnetically attractable items such as tableware which are inadvertently dumped into the chute along with food scraps. A scraper blade is formed to the cover proximate the chute and is configured such that food scraps scraped from plates and the like with the scraper blade fall through the chute and into the trash container.

According to the preferred embodiment of the present invention, the scraper blade comprises a flexible material, preferably either rubber or a resilient polymer material. Further, the scraper blade preferably comprises a generally arcuate, i.e., bowed, edge portion thereof with which food scraps are scraped from plates and the like.

Further, according to the preferred embodiment of the present invention, a bracket is configured to position the scraper blade above the chute. The bracket is configured so as to cause food scraps scraped from plates and the like to fall into the chute.

According to the preferred embodiment of the present invention, the chute is configured and the blade is positioned so as to allow food scraps to be dumped into the chute prior to scraping. That is, the chute is large enough, e.g., long enough, to allow food to be dumped into one end thereof from the plate and to allow scraping further food scraps from the plate at the other end thereof. Preferably, the scraper blade is positioned proximate the rear of the chute, such that food may be dumped from plate at the front end of the chute and then the plate may be scraped at the rear end of the chute, preferably in one substantially continuous motion.

According to the preferred embodiment of the present invention, the magnets and the scraper blade are positioned so as to facilitate dumping of food scraps into the chute proximate the magnets and scraping of the plate in one single, substantially continuous motion. That is, the plate is merely flipped over at the front end of the chute such that larger, heavier food scraps thereon are dumped into the forward end of the chute. Then, the plate is moved rearwardly so as to contact the scraper, thereby scraping remaining further food scraps from the plate into the chute.

Thus, the magnets and the scraper blade are positioned so as to facilitate dumping of food scraps into the chute proximate the magnets and scraping of the plate in one substantially continuous motion merely by inverting the plate over the front of the chute while moving the plate from the front of the chute to the rear thereof and by scraping the plate against the scraper blade as the plate passes thereby. Thus, such configuration of the present invention facilitates quick, easy, and efficient scraping of food scraps from a plate prior to washing of the plate.

The method for disposing of food scraps according to the present invention generally comprises the steps of placing a cover over at least a portion of an opening in a trash container; dumping food scraps from a plate into a chute formed in the cover, the chute directing the food scraps into the trash container; catching tableware introduced into the chute with at least one magnet disposed proximate the chute; and scraping food scraps off of the plate with a scraper which is formed to the cover, such that the food scraps fall through the chute into the trash container. The step of scraping food scraps off of the plate with the scraper preferably comprises scraping food scraps off of the plate with a scraper comprised of a flexible material, preferably either rubber or a resilient polymer. The step of scraping food scraps off of the plate with the scraper preferably further comprises scraping food scraps off of the plate with a scraper having a generally arcuate edge portion. The step of scraping food scraps off of the plate with a scraper preferably comprises scraping food scraps off of the plate with a scraper which is positioned over the chute, so as to cause food scraps scraped off of the plate to fall into the chute.

The method for disposing of food scraps according to the present invention preferably further comprises the step of dumping food scraps into the chute prior to scraping the plate.

The step of scraping food scraps off of the plate with a scraper preferably comprises scraping food scraps off of the plate with a scraper which is positioned proximate the rear of the chute. The steps of dumping food scraps from a plate into a chute and scraping food scraps off of the plate preferably comprise dumping the food scraps into the chute and scraping the food scraps off of the plate in one substantially continuous motion, preferably while moving the plate from the front of the chute to the rear thereof in a manner which is easy, natural, and time-efficient.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and the sequence of steps for constructing and operating the invention in connection with the illustrated embodiment. It is to be understood, however, that the same or equivalent functions may be accomplished by different embodiments that are also intended to be encompassed within the spirit and scope of the invention.

Figure 1:
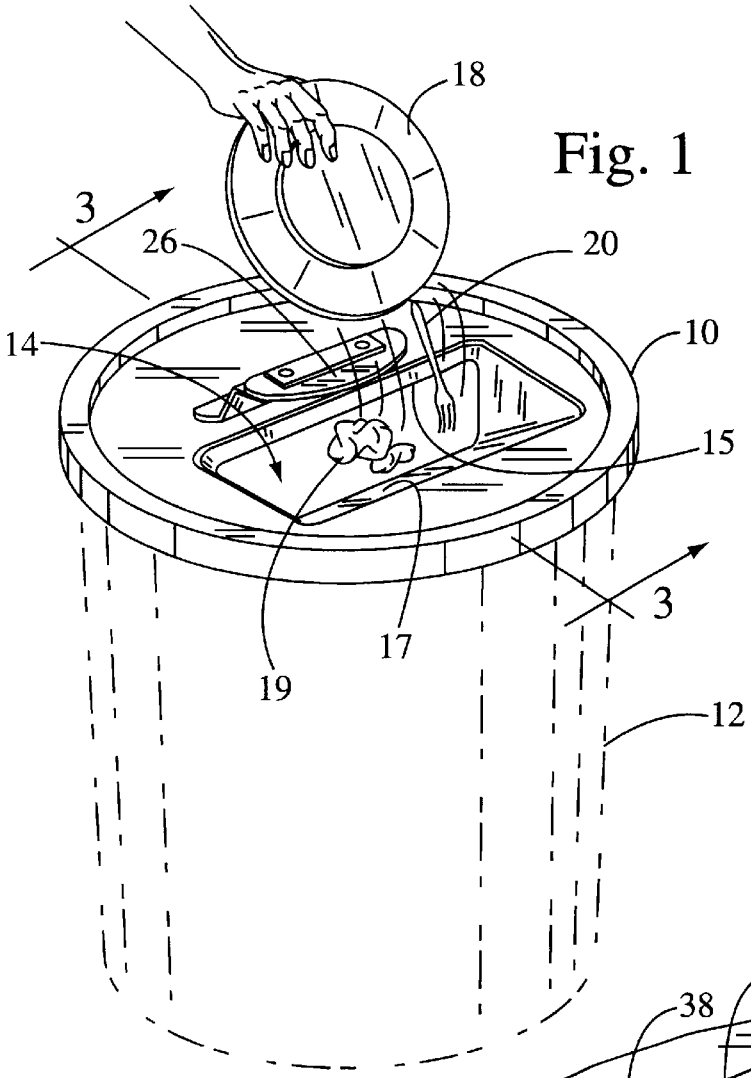
FIG. 1 is a perspective view of the trash container lid of the present invention showing the lid installed upon a trash container and also showing food scraps and a piece of tableware being dumped into the chute thereof.
Figure 2:
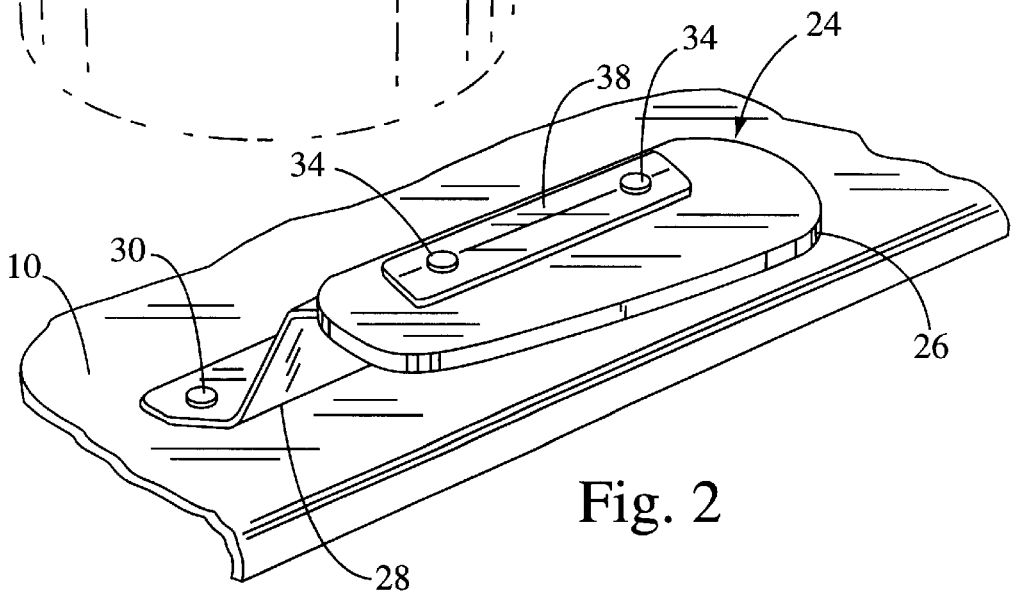
FIG. 2 is an enlarged perspective view of the scraper assembly of FIG. 1.
Figure 3:
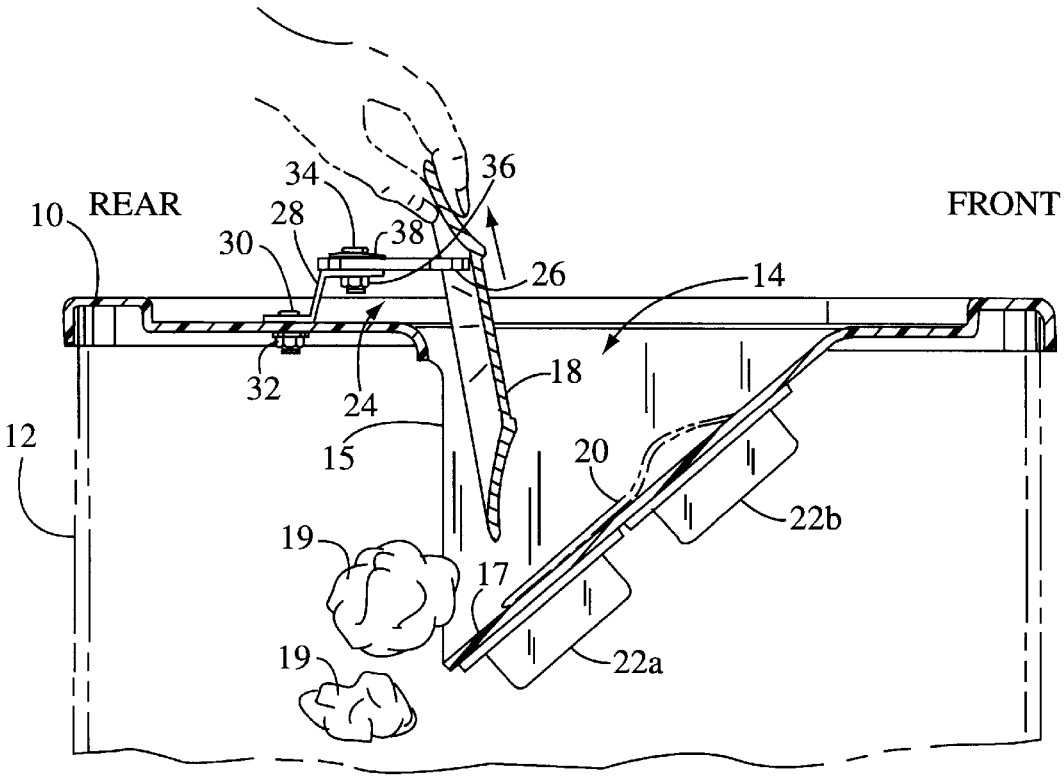
FIG. 3 is a cross-sectional side view of the trash container lid of FIG. 1 showing a plate being scraped with the scraper assembly thereof.

The trash container lid of the present invention is illustrated in FIGS. 1–3 which depict a presently preferred embodiment thereof. Referring now to FIG. 1, the present invention generally comprises a lid 10 configured to at least partially, preferably completely, cover the opening of a trash container 12, such as a trash can or the like. Those skilled in the art will appreciate that the lid may cover only a portion, e.g., one half or one third for example, of the opening in the trash container 12. The lid 10 comprises a chute 14 formed therein and configured to direct food scraps 19 and the like dumped into the chute 14 into the trash container 12. The lid 10 and the chute 14 are preferably formed as molded, integral unit. An opening 15 formed at the lower end of the chute 14 allows food scraps 19 and the like dumped in the chute 14 to enter the trash container 12. Thus, when a plate 18 is inverted over the chute 14, much of the contents of the plate 18, such as food scraps 19 and tableware 20, enters the chute 14.

Referring now to FIG. 2, a scraper assembly 24 comprises a scraper blade 26, which is preferably formed of a durable, resilient material such as rubber or a polymer. The scraper blade 26 is preferably mounted to the lid 10 at the rear of the chute 14 via bracket 28. Bracket 28 is attached to the lid 10 via fasteners, such as bolts 30 and nuts 32 (FIG. 3). The scraper blade 26 is preferably similarly attached to the bracket 28 via bolts 34 and nuts 36. Strain relief plate 38 clamps the scraper blade 26 to the bracket 28, so as to mitigate wear of the scraper blade 26 as it flexes about the fasteners 34 during use thereof.

Referring now to FIG. 3, the scraping of a plate 18 is shown. This will typically occur immediately after the loose contents or food scraps 19 are dumped into the chute 14, as shown in FIG. 1. Indeed, the present invention facilitates both dumping (as shown in FIG. 1) and scraping (as shown in FIG. 3) in a single, continuous motion which is both easy and time efficient, as discussed in detail below.

As shown in FIG. 3, the scraper blade 26 is used to scrape remaining food scraps 19 off of the plate 18. Typically, the upper portion of the plate 18 is brought into contact with the scraper blade 26 and is pulled upwardly along the scraper blade 26 so as to scrape food scraps 19 from the plate 18 and into the chute 14.

First 22*a* and second 22*b* magnets, preferably attached to the bottom 17 of the chute 14, catch and hold magnetically attractable items such as tableware 20 and the like, so as to mitigate the occurrence of inadvertent disposal thereof.

Having described the structure of the magnetic trash container lid with plate scraper of the present invention, it may be beneficial to describe the operation thereof in further detail. Referring now to FIG. 1, the plate is initially at least partially tilted or inverted so as to cause most of the contents thereof to fall into the chute 14 of the lid 10. Generally, the contents of the plate 18 will comprise only food scraps 19 and other trash, e.g., paper napkins, empty condiment packages, etc.

However, in the instance that magnetically attractable tableware 20 is also contained upon the plate 18 when it is inverted above the chute 14, then any magnetically attractable items such as the tableware 20 will typically be captured by the magnets 22*a* and 22*b* (as shown in FIG. 3).

Referring again to FIG. 3, while the plate 18 is still partially inverted, it is lowered substantially into the chute 14 and the plate 18 is brought into contact with the scraper blade 26. The plate 18 is then pulled upwardly and lifted out of the chute 14 in a manner which effects desired scraping of remaining food scraps from the plate 18, thereby rendering the plate 18 ready for placement in an automatic dishwasher and the like.

One important advantage of the present invention is that this procedure, i.e., dumping of food scraps into the chute 14 and subsequent scraping of remaining food scraps from the plate 18, can be performed in one, easy, continuous motion. Another important advantage of the present invention is that this single motion, which includes both dumping and scraping of food scraps, can be performed with one hand. Thus, a plate may be held in each hand and each of the two plates then sequentially dumped and scraped, in turn, so as to substantially enhance the efficiency of preparing the plates for the dishwasher. In this manner, each hand of the person scraping the plates can effect the scrapping of one plate, thereby substantially doubling the number of plates scrapped in a given length of time. Thus, those skilled in the art will appreciate that the present invention provides substantially enhanced labor effectiveness and costefficiency, particularly as compared with the contemporary methodology of utilizing a spatula or the like to scrape food scraps from a plate wherein both hands are utilized to scrape a single plate.

It is understood that the exemplary magnetic trash container lid with plate scraper described herein and shown in the drawings represents only a presently preferred embodiment of the invention. Indeed, various modifications and additions may be made to such embodiment without departing from the spirit and scope of the invention. For example, those skilled in the art will appreciate that the magnets may be placed at various locations within the chute. Further, the use of a circular lid 10, which fits a round trash container 12, is by way of example only and not by way of limitation. Those skilled in the art will appreciate that various different shapes and configurations of lids 10 may be necessary to fit various different shapes of trash containers 12. Indeed, it is not necessary that the lid 10 fully enclose or cover the opening of the trash container 12. Rather, the lid 10 may only cover a portion of the opening of the trash container 12, as desired. Thus, for example, a remaining portion of the opening of the trash container 12 is unobstructed such that trash may be easily dumped directly therein to without having to remove or open the lid 10.

These and other modifications and additions may be obvious to those skilled in the art and may be implemented to adapt the present invention for use in a variety of different applications.

What is claimed is:

1. A trash container lid for facilitating easy disposal of food scraps while inhibiting inadvertent disposal of tableware, the trash container lid comprising:

a) a cover configured to cover at least a portion of an opening in a trash container;

b) a chute formed in the cover and configured to receive food scraps and to direct the food craps into the trash container;

c) at least one magnet disposed proximate the chute to catch tableware inadvertently introduced into the chute; and d) a scraper blade formed to the cover proximate the chute for hand-moved plate engagement whereby surface-tension held food scraps on said plate are scraped therefrom to fall through the chute into the trash container.

2. The trash container lid as recited in claim 1, wherein the scraper blade comprises a flexible material.

3. The trash container lid as recited in claim 1, wherein the scraper blade comprises at least one of rubber and a polymer.

4. The trash container lid as recited in claim 1, wherein the scraper blade comprises a generally arcuate edge portion thereof with which food scraps are scraped from plates and the like.

5. The trash container lid as recited in claim 1, further comprising a bracket configured to position the scraper blade over the chute so as to cause food scraps scraped from plates and the like to fall into the chute.

6. The trash container lid as recited in claim 1, wherein the scraper blade is positioned so as to allow food scraps to be dumped into the chute prior to scraping.

7. The trash container lid as recited in claim 1, wherein the scraper blade is positioned proximate the rear of the chute.

8. The trash container lid as recited in claim 1, wherein the magnets and the scraper blade are positioned so as to facilitate dumping of food scraps into the chute proximate the magnets and scraping of a plate in one continuous motion.

9. The trash container lid as recited in claim 1, wherein the magnets and the scraper blade are positioned so as to facilitate dumping of food scraps into the chute proximate the magnets and scraping of a plate in one continuous motion by inverting the plate over the front of the chute while moving the plate from the front of the chute to the rear thereof and by scraping the plate against the scraper blade as the plate passes thereby.

10. A method for disposing of food scraps, the method comprising the steps of:

a) placing a cover over at least a portion of an opening in a trash container;

b) dumping food scraps from a plate into a chute formed in the cover, the chute directing the food scraps into the trash container;

c) catching tableware introduced into the chute with at least one magnet disposed proximate the chute; and d) scraping surface-tension held food scraps off of the plate by hand-moved plate engagement with a scraper which is formed to the cover, such that the food scraps fall through the chute into the trash container.

11. The method as recited in claim 10, wherein the step of scraping food scraps off of the plate with a scraper comprises scraping food scraps off of the plate with a scraper comprised of a flexible material.

12. The method as recited in claim 10, wherein the step of scraping food scraps off of the plate with a scraper comprises scraping food scraps off of the plate with a scraper comprised of at least one of rubber and a polymer.

13. The method as recited in claim 10, wherein the step of scraping food scraps off of the plate with a scraper comprises scraping food scraps off of the plate with a scraper having a generally arcuate edge portion.

14. The method as recited in claim 10, wherein the step of scraping food scraps off of the plate with a scraper comprises scraping food scraps off of the plate with a scraper which is positioned over the chute so as to cause food scraps scraped off of the plate to fall into the chute.

15. The method as recited in claim 10, further comprising the step of dumping food scraps into the chute prior to scrapping the plate.

16. The method as recited in claim 10, wherein the step of scraping food scraps off of the plate with a scraper comprises scraping food scraps off of the plate with a scraper which is positioned proximate the rear of the chute.

17. The method as recited in claim 10, wherein the steps of dumping food scraps from a plate into a chute and scraping food scraps off of the plate comprise dumping the food scraps into the chute and scraping the food scraps off of the plate in one continuous motion.

18. The method as recited in claim 10, wherein the steps of dumping food scraps from a plate into a chute and scraping food scraps off of the plate comprise dumping the food scraps into the chute and scraping the food scraps off of the plate in one continuous motion while moving the plate from the front of the chute to the rear thereof.

* * * * *